US010334925B2

(12) United States Patent
Mena et al.

(10) Patent No.: US 10,334,925 B2
(45) Date of Patent: Jul. 2, 2019

(54) NECKTIE BRIEFCASE

(71) Applicants: Jose Mena, New York, NY (US); Victor Mena, New York, NY (US)

(72) Inventors: Jose Mena, New York, NY (US); Victor Mena, New York, NY (US)

( * ) Notice: Subject to any disclaimer, the term of this patent is extended or adjusted under 35 U.S.C. 154(b) by 189 days.

(21) Appl. No.: 15/353,467

(22) Filed: Nov. 16, 2016

(65) Prior Publication Data

US 2018/0132587 A1 May 17, 2018

(51) Int. Cl.
*A45C 13/03* (2006.01)
*A45C 5/03* (2006.01)

(52) U.S. Cl.
CPC ..... *A45C 13/03* (2013.01); *A45C 5/03* (2013.01); *A45C 2005/037* (2013.01)

(58) Field of Classification Search
CPC ..... A45C 13/03; A45C 5/03
See application file for complete search history.

(56) References Cited

U.S. PATENT DOCUMENTS 1,653,658 A * 12/1927 Rasmussen ..... A45C 13/03 190/13 C
1,869,447 A * 8/1932 Wheary ..... A45C 13/03 206/289
D97,114 S * 10/1935 Britz ..... D6/316
2,129,905 A * 9/1938 Bracken ..... A45C 13/03 211/124
2,634,031 A * 4/1953 Klein ..... A47G 25/743 211/119

* cited by examiner

*Primary Examiner* — Tri M Mai
(74) *Attorney, Agent, or Firm* — Scarinci Hollenbeck, LLC

(57) ABSTRACT

A necktie briefcase comprising top and bottom enclosures defining a storage compartment, support rods removably mounted within the storage compartment near and parallel to a first longitudinal side in each of the top and bottom enclosures, a restraining strap removably attached within the storage compartment near and parallel to a second longitudinal side in each of the top and bottom enclosures and a plurality of neckties hung on each of the support rods and positioned behind the restraining strap such that the neckties are secured against an interior wall in each of the top and bottom enclosures.

5 Claims, 6 Drawing Sheets

NECKTIE BRIEFCASE

FIELD OF THE INVENTION

The present application relates to a briefcase, and more particularly to a briefcase for carrying, storing, and displaying various types of neckties.

BACKGROUND

The standard necktie is often displayed within a clothing store on handing racks or on shelving in a manner which does not help to set the neckties apart from other surrounding apparel within the clothing store. The apparel industry is missing an efficient way of displaying neckties in an elegant and sophisticated manner that helps set the displayed neckties apart from other apparel within a prestigious clothing stores and boutiques. Moreover, there also exist a need for displaying and transporting a grouping of neckties based on a theme in a similarly elegant and sophisticated manner.

SUMMARY

In order to address the above described needs, a necktie briefcase is presented comprising top and bottom enclosures defining a storage compartment, support rods removably mounted within the storage compartment near and parallel to a first longitudinal side in each of the top and bottom enclosures, and a restraining strap removably attached within the storage compartment near and parallel to a second longitudinal side in each of the top and bottom enclosures. A plurality of neckties are hung on each of the support rods and positioned behind the restraining strap such that the neckties are secured against an interior wall in each of the top and bottom enclosures.

BRIEF DESCRIPTION OF THE DRAWINGS

There are shown in the drawing embodiments of the present invention which are presently discussed however it is understood that the present invention is not limited to the precise arrangements and instrumentalities shown therein, wherein.

DETAILED DESCRIPTION OF THE INVENTION

Exemplary embodiments of the present invention are described with respect to a briefcase for carrying, storing, and displaying neckties. More specifically, the necktie briefcase includes a necktie support rod mounted within each enclosure comprising the briefcase on which are hung multiple neckties. Retaining clips and straps mounted within each enclosure help secure each necktie flat again an inner wall of each enclosure. It should be understood by one of ordinary skill in the art that exemplary embodiments of the present disclosure can be applied to other types of briefcases. The term briefcase as used herein can include a variety of different types of enclosures including a traditional briefcase, a business case, a travel bag or any other similar types of storage case. As such, the structural and functional details disclosed herein are not to be interpreted as limiting, but merely as a representative basis for teaching one reasonably skilled in the art to employ various embodiments of the present invention.

Figure 1:
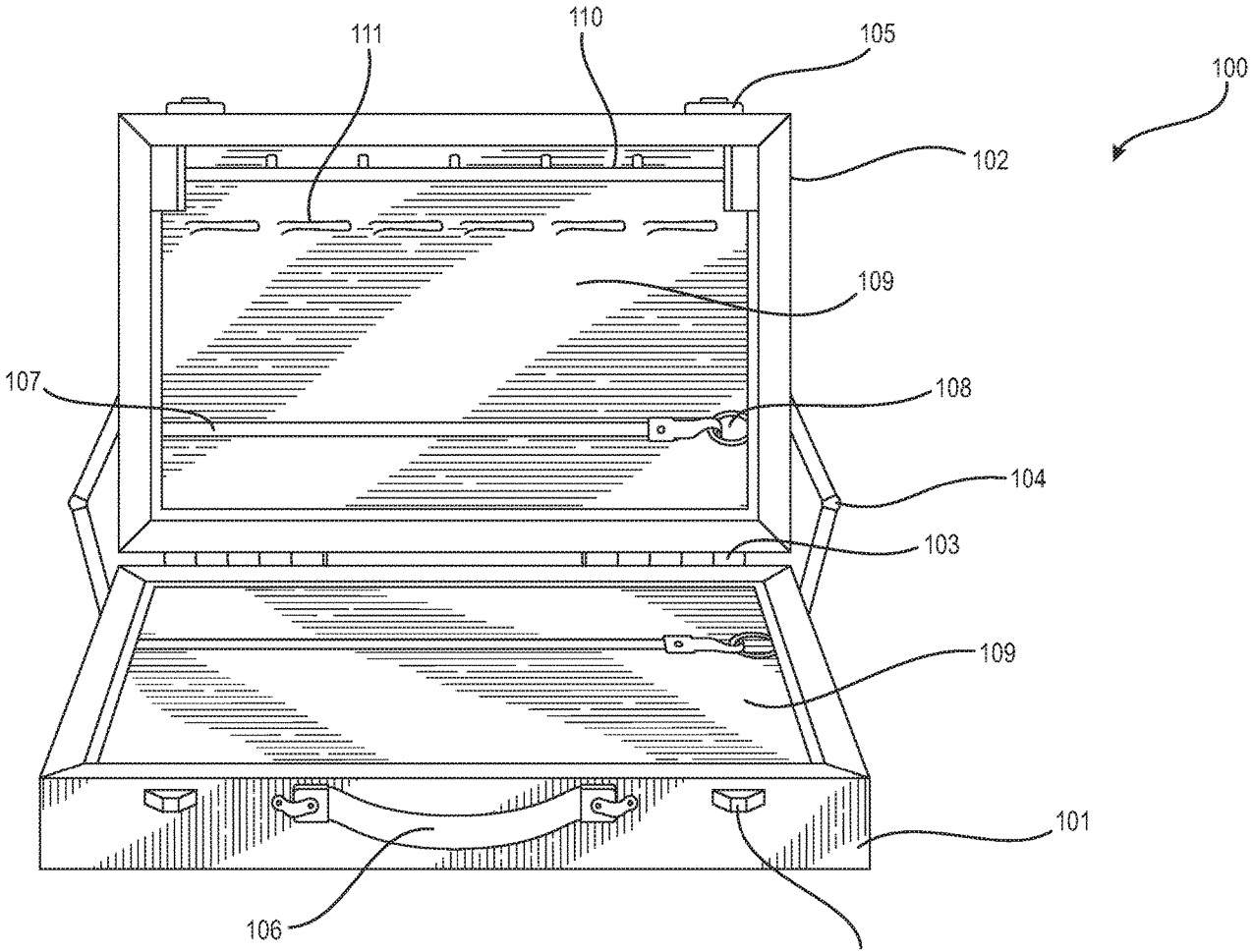
FIG. 1 depicts a front perspective interior view of the necktie briefcase without neckties according to an exemplary embodiment of the present invention.

In FIG. 1, a front perspective interior view of the necktie briefcase without neckties according to an exemplary embodiment of the present invention is depicted. As shown in FIG. 1, the necktie briefcase 100 includes a concave bottom portion 101 and a concave top portion 102 which together form at least one storage compartment 109 within the necktie briefcase 100. Neckties are stored, carried, and displayed within the at least one storage compartment 109. The top and bottom enclosures 101, 102 are similar in shape such as to ensure that the at least one storage compartment 109 is formed in a secure manner when the necktie briefcase is in a closed position. The shape of the enclosures be any shape suitable for a briefcase or any other storage case including square and rectangular shaped. Moreover, the outer shell of each enclosure 101, 102 may be formed from any suitable material that will provide the necessary structural support including a hard thermoplastic. The outer surface of each enclosure 101, 102 may be covered with any suitable material including leather. The inner surface may be lined with any suitable decorative material that will protect the contents of the necktie briefcase including leather, silk, and felt.

As with standard storage cases, the necktie briefcase 100 includes a set of hinges 103 permanently attached along the outer edges on the same longitudinal side of each of the enclosures 101, 102. The hinges 103 are positioned and aligned such as to provide for the smooth rotational movement of the enclosures 101, 102 between an open position that allows access to the at least one storage compartment 109 and a closed position that secures the at least one storage compartment 109 from access.

A handle 106 is permanently attached to the bottom enclosure 101, centered on the outer edge of the longitudinal side opposite the hinges 103.

A set of complementary latches 105 are permanently attached on both enclosures 101, 102, on the outer surface of the longitudinal side opposite the hinges 103 of each of the enclosures 101, 102. The complementary latches 105 on each of the enclosures 101, 102 are positioned as to align with each other when the briefcase 100 is in a closed position. The latches 105 may also provide a locking mechanism that requires a key or a combination code to open the necktie briefcase 100.

A guide bar 104 is attached to the outer edge of the adjacent sides near the hinges 103 on each of the enclosures 101, 102. The guide bars 104 support the movement of the enclosures 101, 102 about the hinges 103 for a range between zero and ninety degrees relative to each other. The guide bars 104 also provide sufficient resistance as to allow the top enclosure 101 to remain in an open position between zero and ninety degrees relative to the bottom enclosure 102 while restricting the rotation of the enclosures 101, 102 to no more than to ninety degrees relative to each other.

A support rod 110 is mounted on the inner edge of the adjacent sides of each enclosure 101, 102 near the latches 105. The support bar 110 is positioned such as to leave a gap between the support rod 110 and the neighboring longitudinal side of each enclosure 101, 102. The gap being large enough to fit at least three neckties laid on top of each other without crushing them. Each support rod 110 is shaped and dimensioned to run parallel to and for the length of the neighboring longitudinal side.

The support rods 110 may be mounted in a manner known to one of reasonable skill in the art to allow for the amount of gap provided to be adjustable between a minimum and a maximum gap amount. The gap amount may be selected based on a number of factors such as the number of ties to be stacked on top of each other and the length of the individual ties.

A retaining clip 111 is used on each necktie to clip together the two portions of a necktie hanging down on opposite sides of the support bar 110. The retaining clips 111 are positioned near the support bar 110 so as to secure the upper portions of the neckties and to keep them from sliding off of the support bar 110. Moreover, the retaining clips 111 may be secured to the inner surface of each enclosure 101, 102, each retaining clip positioned to line up with each necktie 201 draped over the support bar 108. The retaining clips 111 are sized and dimensioned to accommodate the standard width of the upper portion of a tie without folding or crushing the edges the tie.

A retaining strap 107 within each of the enclosures 101, 102 runs parallel and for the length of the longitudinal sides, one end of the retaining strips 107 permanently attached to the inner edge of an adjacent side within each of the enclosures 101, 102. The other end of the retaining strap 107 removably attached to a retaining clip 108 that is permanently attached to the inner edge of the opposing adjacent side within each of the enclosures 101, 102.

The retaining strap 107 is positioned within each enclosure 101, 102 as to line up near the widest bottom portion of the individual ties hung over the support rod 110 within each of the enclosure 101, 102.

The retaining strap 107 may be made from any suitable material known to one of reasonable skill in the art including leather or any elastic material. Moreover, the retaining strap 107 is sized and dimensioned such that when secured in place using the retaining clip 108, it provides sufficient pressure to hold the hanging neckties 201 flat against the back wall of each of the enclosures 101, 102.

The individual retaining clips 111 in combination with the retaining strap 107 ensure that the full length of each tie hung on the supporter rods 110 is kept flat against the inside surface each enclosure 101, 102. This helps prevent any folding and creasing of the ties while stored, carried, and displayed within the necktie briefcase.

Figure 2:
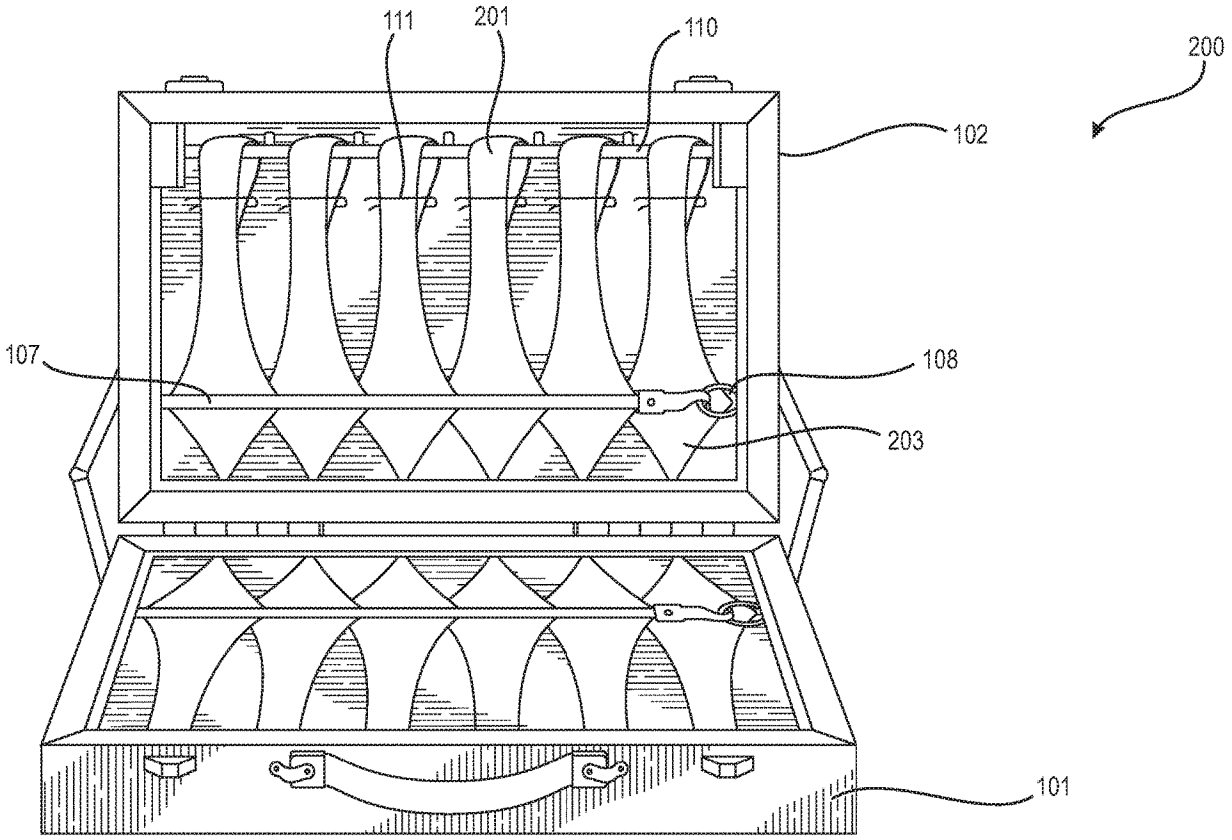
FIG. 2 depicts a front perspective interior view of the necktie briefcase fully populated with neckties according to an exemplary embodiment of the present invention.

In FIG. 2, a front perspective interior view of the necktie briefcase fully populated with neckties according to an exemplary embodiment of the present invention is depicted. As shown in FIG. 2, individual neckties 201 are mounted and displayed within both of the enclosures 101, 102. The neckties 201 are draped over the support bar 108 in each of the enclosures 101, 102 with the wider portion of each necktie 203 facing outward from within the storage compartment 109.

The neckties 201 hanging from the support bar 108 are secured in place using the individual retaining clips 111 and the retaining strap 107. As described above, the thinner middle portion of the ties are secured using the retaining clips 111 and the end portions of the tie are secured using the retaining strap 107.

Figure 3:
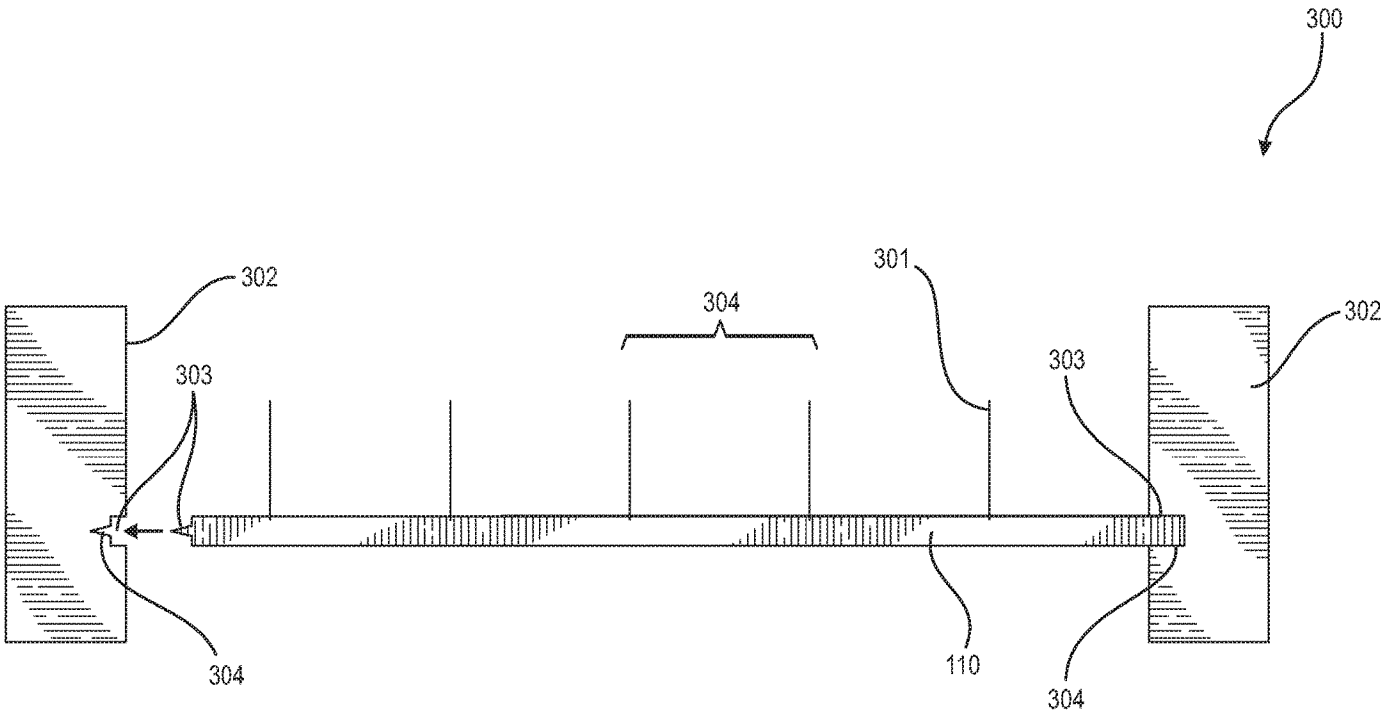
FIG. 3 depicts an exploded view of the necktie support bar according to an exemplary embodiment of the present invention.

In FIG. 3, an exploded view of the necktie support bar according to an exemplary embodiment of the present invention is depicted. As shown in FIG. 3, the support bar 110 is secured to each enclosure 101, 102 using a pair of mounting blocks 302 permanently attached to the adjacent sides of each of the enclosures 101, 102. Each of the mounting blocks 302 include an indentation 304 into which the ends 303 of the support rod 110 are inserted so as to secure the support rod 110 within each of the enclosures 101, 102. The support rod 110 may be made of rigid material with limited flexible such that the support rod 110 may be flexed a minimal amount as to position the ends 303 securely within the mounting blocks 302.

Alternatively, the ends 303 of the support rods 110 and the indentations 304 within the mounting blocks 302 may be keyed such that each end 303 fits into a specific indentation 304 with a mounting block 302. In such a configuration, one of the keyed ends 303, 304 may provide for a mechanism for securing the support rod 110 in place using a lateral movement without having to flex the support rod 110 in order to position the ends 303 within the indentations 304 of the mounting blocks 302.

Moreover, as described above, the support rods 110 may be mounted at varying heights within each of the enclosures 101, 102. A person of reasonable skill in the art will realize that multiple mounting methods may be used to allow for adjusting the mounting height of each support rod with and enclosure while still remaining within the scope of the present invention including having multiple indentation 304 within the mounting block 302 at varying heights.

The support rods 110 may include a plurality of spacers 301 which rise up perpendicularly from the surface of each of the support rods 110. The areas between adjacent spacers 301 as well as between the mounting blocks 302 and a neighboring spacer 301 each define an individual position 304 for a necktie on the support rod 110. The number of spacers 301 on the support rod 110 and the amount of space 304 between neighboring spacers 301 may be customized as needed to provide for ties with differing widths.

The support bar 110 may be lined with any suitable material such as felt such as to help protect the neckties 201 and help avoid slippage of the neckties off of the support rod 110. A flexible foam like material may also be inserted in-between the outer surface of the support rod 110 and the outer lining material.

Figure 4:
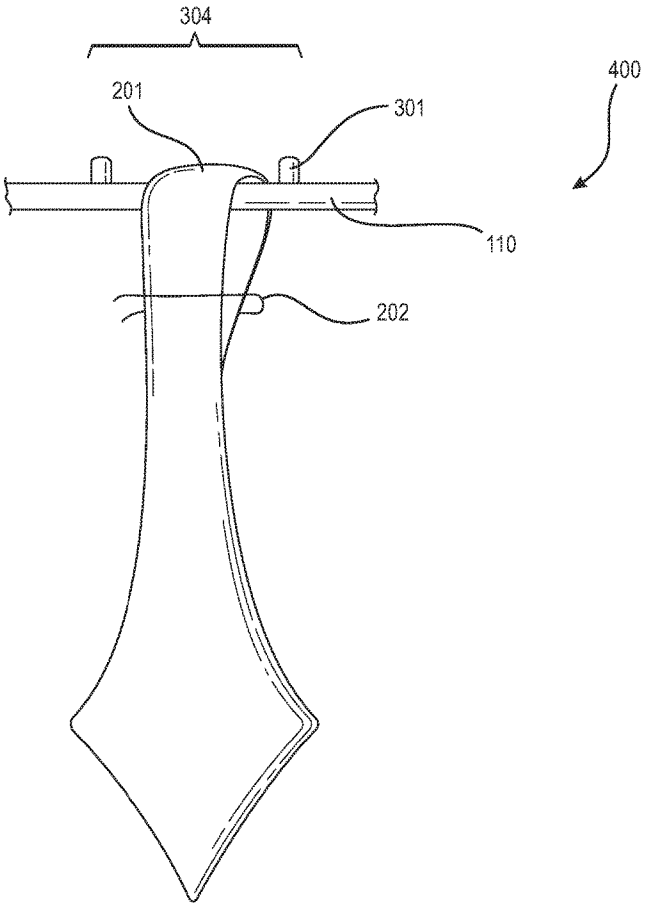
FIG. 4 depicts an exploded view of a necktie secured on the support bar according to an exemplary embodiment of the present invention.

In FIG. 4, an exploded view of a necktie secured on the support bar according to an exemplary embodiment of the present invention is depicted. As shown in FIG. 4, a necktie 201 is hung over the support bar 110 within each of the locations 304 defined by neighboring spacers 301. The necktie 201 is hung over the support bar 110 with the larger bottom portion 203 of the necktie facing outward from within the storage compartment 109 thereby displaying the neckties as they would actually be worn. A retaining clip 202 holding together the front and the back middle portions of the hanging necktie 201 is positioned below the support bar 110 so as to help secure the necktie onto the support bar 110. The retaining clips 201 are mounted on the inside surface of each of the enclosures 101, 102.

Figure 5:
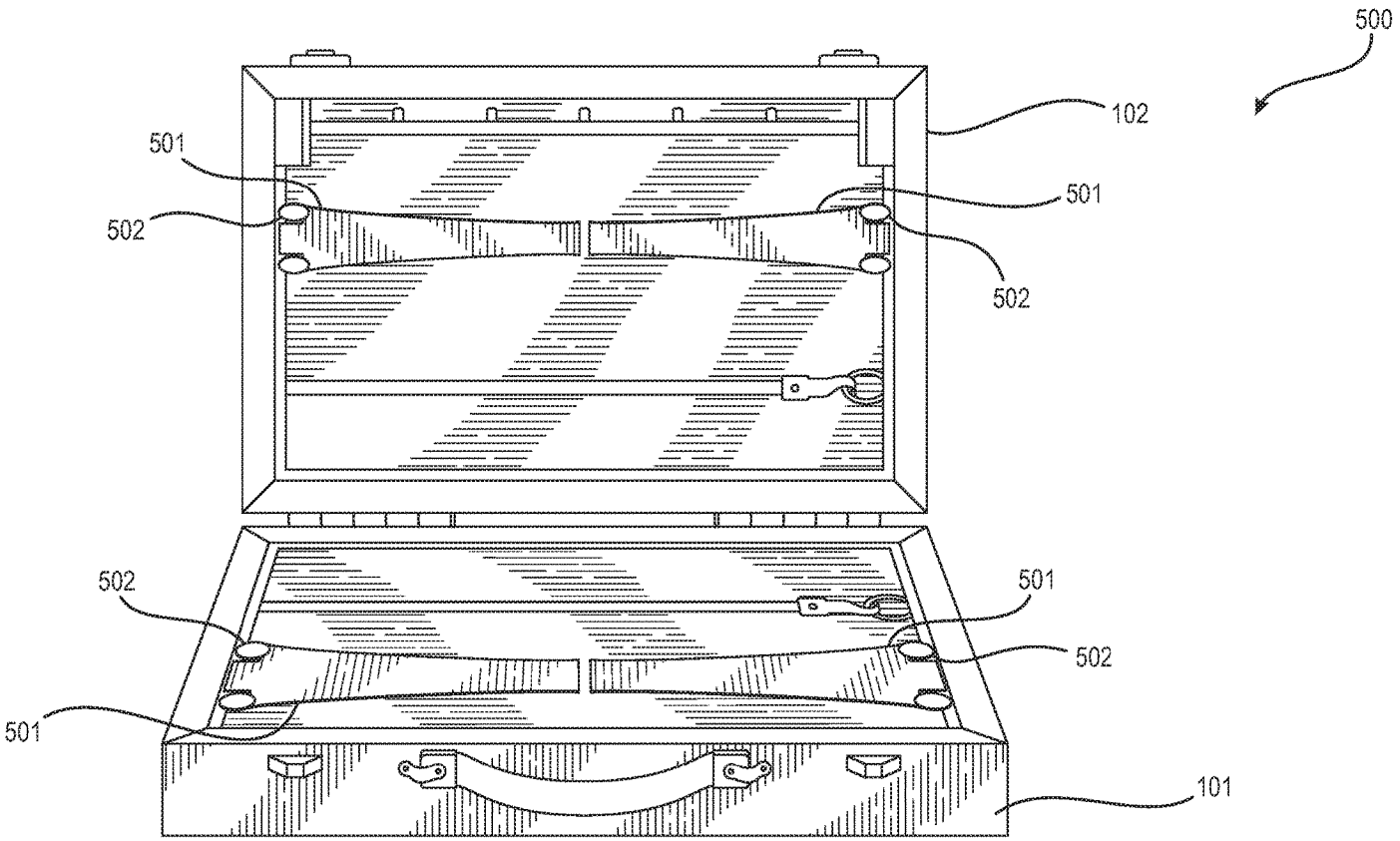
FIG. 5 depicts an exploded interior view of the necktie briefcase with a pair of spring loaded retaining arms according to another exemplary embodiment of the present invention.

In another exemplary embodiment of the present invention, the retaining clips are replaced with a pair of spring loaded retaining arms. In FIG. 5, an exploded interior view of the necktie briefcase with a pair of spring loaded retaining arms according to another embodiment of the present invention is depicted. As shown in FIG. 5, the structure of the necktie briefcase 500 is similar to the previously described exemplary embodiments except for the addition of a pair of retaining arms 501 mounted on the inside adjacent edges of each of the enclosures 101, 102. The length of each retaining arm 501 is no more than half the longitudinal length of the inside surface of each of the enclosures 101, 102. As such, each retaining arm 501 will cover at least half of the ties mounted on the support bar 110.

The retaining arms 501 are each mounted using a spring loaded mount 502 permanently attached to the inside adjacent edges of the enclosures 101, 102. These mounts 502 bias each retaining arm 501 closed in a position adjacent to the inner surface of each of the enclosures 101, 102. Moreover, the mounts 502 allow each retaining arm 501 to swing outward from within the enclosures 101, 102 at least ninety degrees relative to the inner surface.

The retaining arms 501 may be fabricated from any rigid material including metal and plastic. Moreover, they may be of varying heights which allow the retaining arms 501 to fit fully within the enclosure 101, 102 while overlapping a major portion of each of the neckties. Lastly, each retaining arms 501 may be single solid piece of material or may be hollowed out piece of material.

Figure 6:
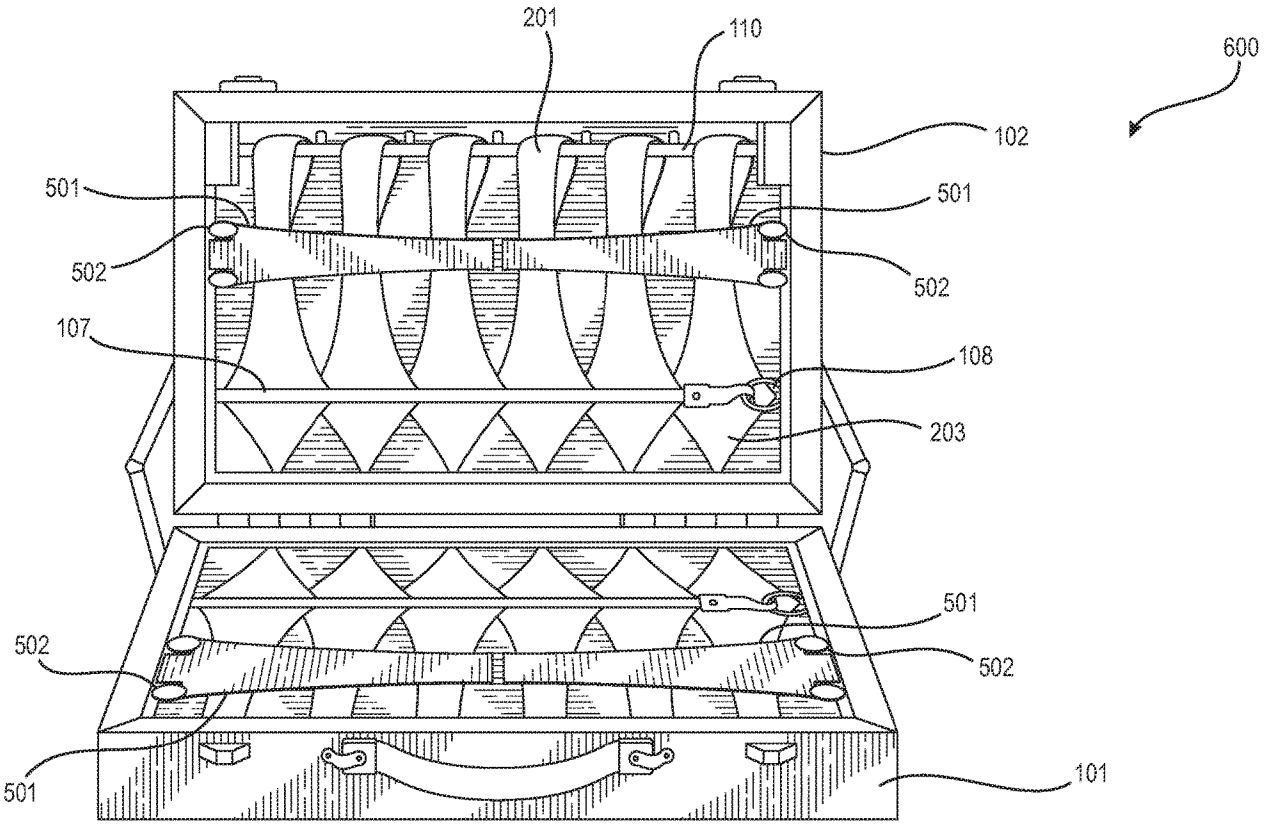
FIG. 6 depicts an exploded interior view of the necktie briefcase fully populated with neckties according to another exemplary embodiment of the present invention.

In FIG. 6, an exploded interior view of the necktie briefcase fully populated with neckties according to another exemplary embodiment of the present invention is depicted. As shown in FIG. 6, the individual neckties 201 are mounted and displayed within both of the enclosures 101, 102. The neckties 201 are draped over the support bar 110 in each of the enclosures 101, 102 with the wider portion of each necktie 203 facing outward from within the storage compartment 109.

The neckties 201 hanging from the support bars 108 are secured in place using the retaining arms 501 and the retaining strap 107. The thinner upper portion of the ties are secured using the retaining arms 501 and the lower wider portions of the ties are secured using the retaining strap 107.

It is claimed:

1. A necktie briefcase comprising:

top and bottom enclosures defining a storage compartment;

support rods mounted within the storage compartment near and parallel to a first longitudinal side in each of the top and bottom enclosures;

a restraining strap removably attached within the storage compartment near and parallel to a second longitudinal side in each of the top and bottom enclosures;

a pair of retainer arms mounted on opposite adjacent sides of each of top and bottom enclosures, each retainer arm mounted with a spring loaded mount that biases the retainer arm closed against the interior surfaces and allowing the retainer arms to swing outward from within the storage compartment; and a plurality of neckties configured to be hung on each of the support rods and positioned behind the restraining strap and retainer arms such that the neckties are secured against an interior wall in each of the top and bottom enclosures.

2. The necktie briefcase of claim 1 further comprising:

a plurality of spacers adjustably distributed across each of the support rods, the plurality of spacers defining locations for each of the plurality of neckties hung on each of the support rods.

3. The necktie briefcase of claim 1 further comprising:

a plurality of retainer clips adjustably mounted on the interior surfaces and distributed parallel to the first longitudinal sides of each of the top and bottom enclosures, the retainer clips positioned near the supports rods as to line up with the middle portion of each of the ties hanging on the support rods.

4. The necktie briefcase of claim 1 wherein the retaining strap is positioned within each of the top and bottom enclosures to line up near a widest portion of the neckties hung on the support rods.

5. The necktie briefcase of claim 1 wherein the top and bottom enclosures have a height that is at least sufficient to accommodate approximately half the length of a standard tie hanging on the support rods.

* * * * *